US010804030B2

(12) United States Patent
Tseng et al.

(10) Patent No.: US 10,804,030 B2
(45) Date of Patent: Oct. 13, 2020

(54) PROCESS FOR MAKING A LOW-PROFILE CHOKE

(71) Applicant: SIWARD CRYSTAL TECHNOLOGY CO., LTD., Taichung (TW)

(72) Inventors: Yen-Hao Tseng, Jhunan Township, Miaoli County (TW); Shih-Ying Huang, Jhunan Township, Miaoli County (TW); Yu-Hsuan Peng, Jhunan Township, Miaoli County (TW); Wei-Chih Hsu, Jhunan Township, Miaoli County (TW); Wei-Lin Wang, Jhunan Township, Miaolu County (TW); Wen-Kuan Huang, Jhunan Township, Miaoli County (TW)

(73) Assignee: SIWARD CRYSTAL TECHNOLOGY CO., LTD. (TW)

( * ) Notice: Subject to any disclaimer, the term of this patent is extended or adjusted under 35 U.S.C. 154(b) by 317 days.

(21) Appl. No.: 16/008,543

(22) Filed: Jun. 14, 2018

(65) Prior Publication Data

US 2019/0172638 A1 Jun. 6, 2019

(30) Foreign Application Priority Data

Dec. 4, 2017 (TW) ..... 106142402 A

(51) Int. Cl.

| | |
|---|---|
| ***H01F 7/06*** | (2006.01) |
| ***H01F 41/04*** | (2006.01) |
| ***H01F 41/12*** | (2006.01) |
| ***H01F 41/02*** | (2006.01) |
| *H01F 17/00* | (2006.01) |

(52) U.S. Cl.

CPC ..... *H01F 41/043* (2013.01); *H01F 41/0246* (2013.01); *H01F 41/046* (2013.01); *H01F 41/12* (2013.01); *H01F 17/0013* (2013.01); *H01F 2017/0066* (2013.01); *Y10T 29/49155* (2015.01)

(58) Field of Classification Search

CPC ..... H01F 41/043; H01F 41/046; H01F 41/12; H01F 41/0246; H01F 2017/0066; H01F 17/0013; Y10T 29/4902; Y10T 29/49073; Y10T 29/49155

USPC ..... 29/602.1, 606, 846, 852

See application file for complete search history.

(56) References Cited

U.S. PATENT DOCUMENTS 6,830,970 B2 * 12/2004 Gardes ..... H01F 17/0006 257/277

7,870,665 B2 * 1/2011 Nomura ..... H01F 17/0013 205/125

(Continued)

*Primary Examiner* — Donghai D Nguyen

(74) *Attorney, Agent, or Firm* — Cardinal Law Group LLC

(57) ABSTRACT

A process for making a low-profile choke includes steps of: providing an etchable substrate; applying a masking layer on the etchable substrate; etching the etchable substrate through perforated patterns of the masking layer to permit the etchable substrate to be formed with an array of recessed patterns, each of which includes a core recess portion and a coil-patterned recess portion; filling a magnetic material and a conductive material respectively into the core recess portion and the coil-patterned recess portion of each of the recessed patterns to form in the etchable substrate a plurality of magnetic cores and a plurality of conductive coils; and slicing the etchable substrate to obtain a plurality of choke bodies.

14 Claims, 13 Drawing Sheets

(56) References Cited

U.S. PATENT DOCUMENTS 9,269,485 B2 * 2/2016 Chang ..... H01F 17/0013
9,761,545 B2 * 9/2017 Sin ..... H01F 21/00

* cited by examiner

PROCESS FOR MAKING A LOW-PROFILE CHOKE

CROSS-REFERENCE TO RELATED APPLICATION

This application claims priority of Taiwanese Application No. 106142402, filed on Dec. 4, 2017.

FIELD

The disclosure relates to a process for making a choke, and more particularly to a process for making a low-profile choke.

BACKGROUND

A choke is an inductor used to block higher-frequency alternating current in an electrical circuit while passing lower-frequency current or direct current, and is commonly used in a power supplier of an electronic device.

US 2013/0106562 discloses an inductor coil structure and a method for making same.

Referring to FIG. 1, an inductor 1 disclosed in US 2013/0106562 is configured to be mounted on a circuit board 10, and includes a pair of leads 11 displaced from each other, a wire coil 12, and an inductor body 13. The wire coil 12 includes an inner end 121, an outer end 122, and a plurality of turns 123 interconnecting with the inner and outer ends 121, 122. The inner end 121 and the outer end 122 of the wire coil 12 are welded to the pair of the leads 11, respectively. A most inner one and a most outer one of the turns 123 are connected to the inner end 121 and the outer end 122 of the wire coil 12, respectively. The wire core 12 is encapsulated by the inductor body 13. The pair of the leads 11 extend outwardly from the inductor body 13 and are soldered to the circuit board 10.

Referring to FIG. 2, in a method for making the inductor 1, the wire coil 12 is formed from a flat wire having a rectangular cross section. An end 112 of each of two leads 111 of a lead frame 110 is welded to a corresponding one of the inner and outer ends 121, 122 of the wire coil 12. Specifically, one of two ends of the flat wire is welded to the end 112 of one of the two leads 111 of the lead frame 110. The wire coil 12 is formed by winding the flat wire into a helix. The other of the two ends of the flat wire is welded to the end 112 of the other of the two leads 111 of the lead frame 110. The turns of the wire coil 12 are bonded together by bonding or heating.

A powdered material containing a powdered iron, a filler, a resin, and a lubricant is compressed completely around the wire coil 12 in a pressure molding machine to cause the powdered material to be compressed and molded tightly around the wire coil 12 so as to form the inductor body 13. The lead frame 110 is cut from the leads 111, 112. The leads 111, 112 are then bent so as to be folded against a bottom surface of the inductor body 13 to obtain the inductor 1.

The method disclosed in US 2013/0106562 can merely make a single one of the inductor 1 at a time. Therefore the productivity of the method is unsatisfactory. Furthermore, the inductor 1 thus made has a size in an order of as large as millimeters, and therefore is unsuitable for development of miniaturization of portable electronic devices.

SUMMARY

An object of the disclosure is to provide a process for making a low-profile choke more efficiently.

According to the disclosure, there is provided a process for making a low-profile choke comprising steps of:

a) providing an etchable substrate having a top surface and a bottom surface;

b) applying on one of the top and bottom surfaces of the etchable substrate a first masking layer including an array of first perforated patterns which are displaced from each other by a predetermined spacing and each of which includes a first perforation and a first coil-patterned slit having a first inner slit end and a first outer slit end and disposed to surround the first perforation;

c) etching the etchable substrate through the first perforated patterns of the first masking layer to permit the etchable substrate to be formed with an array of first recessed patterns which are recessed from said one of the top and bottom surfaces of the etchable substrate, each of the first recessed patterns including a first core recess portion which corresponds to the first perforation and a first coil-patterned recess portion which corresponds to the first coil-patterned slit and which has a depth smaller than that of the first core recess portion;

d) filling a magnetic material and a conductive material respectively into the first core recess portion and the first coil-patterned recess portion of each of the first recessed patterns so as to form in the etchable substrate a plurality of first magnetic cores and a plurality of first conductive coils, each with a first inner end and a first outer end respectively corresponding to the first inner slit end and the first outer slit end of the first coil-patterned slit; and e) slicing the etchable substrate along the predetermined spacing to obtain a plurality of choke bodies.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
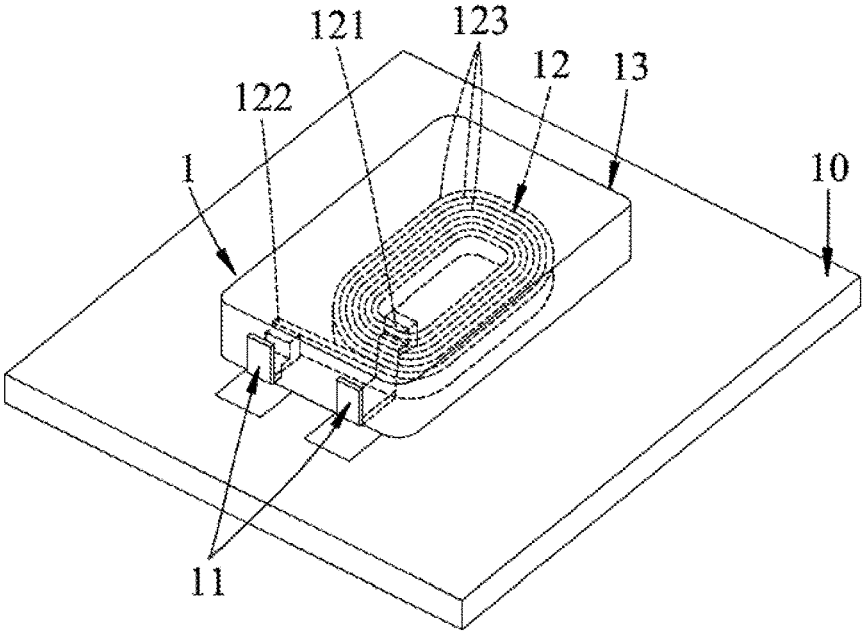
FIG.1 PRIOR ART
FIG. 1 is a perspective view of an inductor disclosed in US 2013/0106562 which is mounted on a circuit board.
Figure 2:
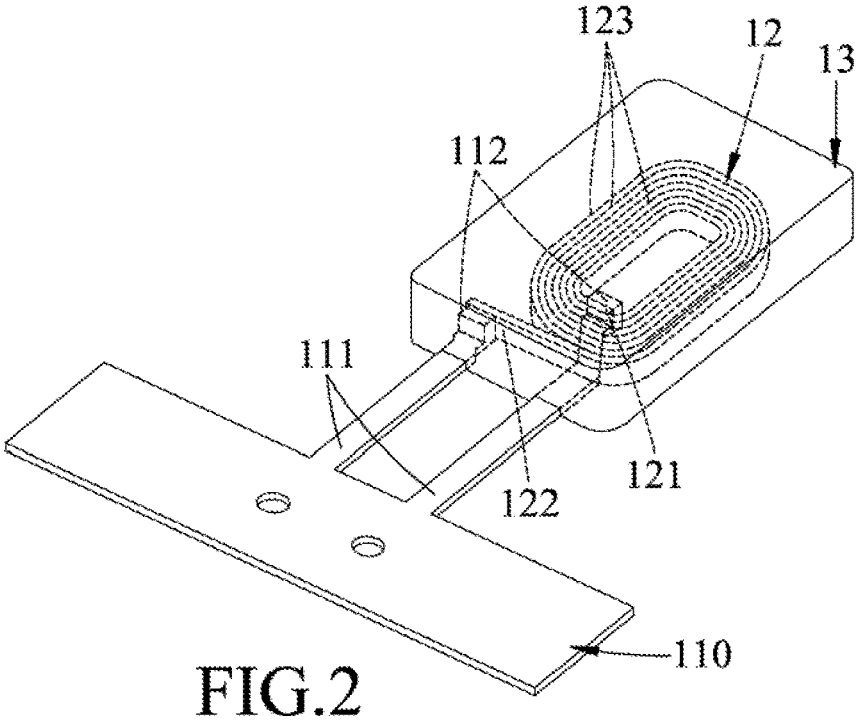
FIG.2 PRIOR ART
FIG. 2 is a perspective view illustrating the inductor of FIG. 1 in a state before the inductor is cut from a lead frame.

Before the disclosure is described in greater detail, it should be noted that where considered appropriate, reference numerals or terminal portions of reference numerals have been repeated among the figures to indicate corresponding or analogous elements, which may optionally have similar characteristics.

A process for making a low-profile choke according to the disclosure is performed using a micro-electro-mechanical system. A low-profile choke made by the process of the disclosure can be electrically connected to a circuit.

Referring to FIGS. 3-12, a first embodiment of a process for making a low-profile choke according to the disclosure comprises steps of:

A) providing an etchable substrate 200;

B) applying a first masking layer 9;

C) etching the etchable substrate 200;

D) filling a magnetic material and a conductive material;

E) removing the first masking layer 9;

F) applying an insulation strip layer 5;

G) applying a conductive material on the insulation strip layer 5;

H) applying a magnetic cover layer 80; and

I) slicing the etchable substrate 200.

Figure 3:
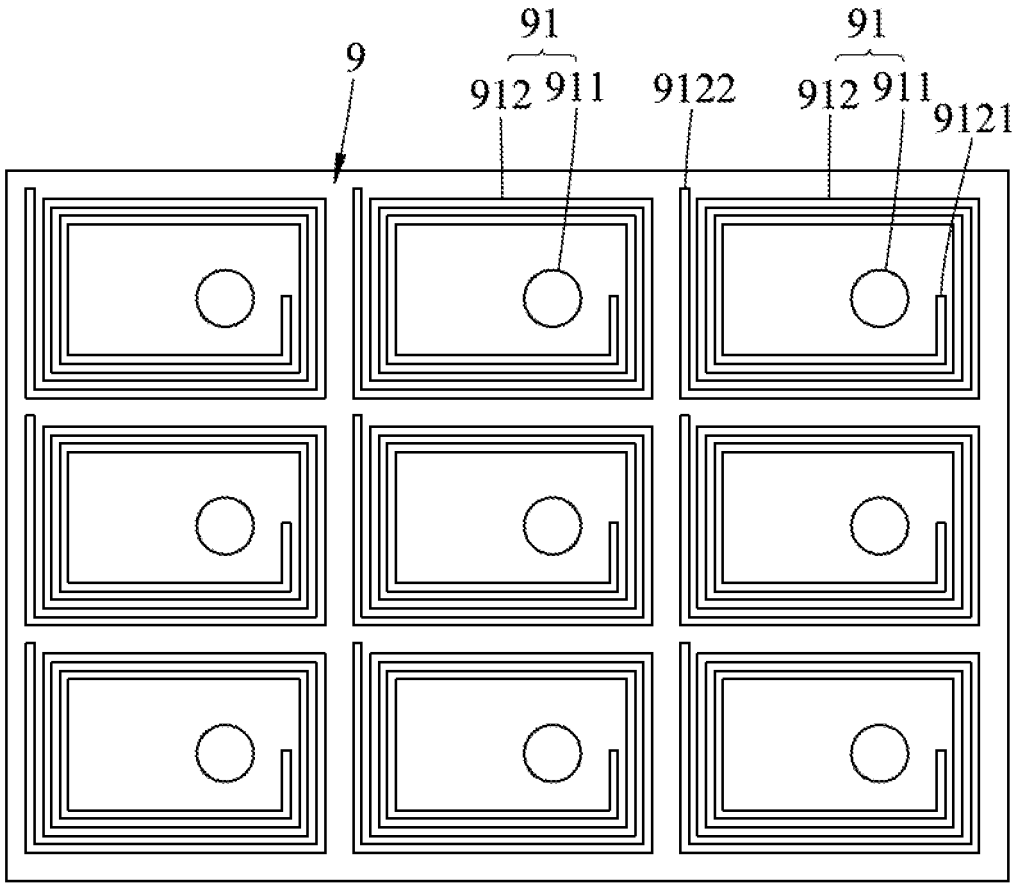
FIGS. 3 to 12 are schematic views showing consecutive steps of a first embodiment of a process for making a low-profile choke according to the disclosure.
Figure 4:
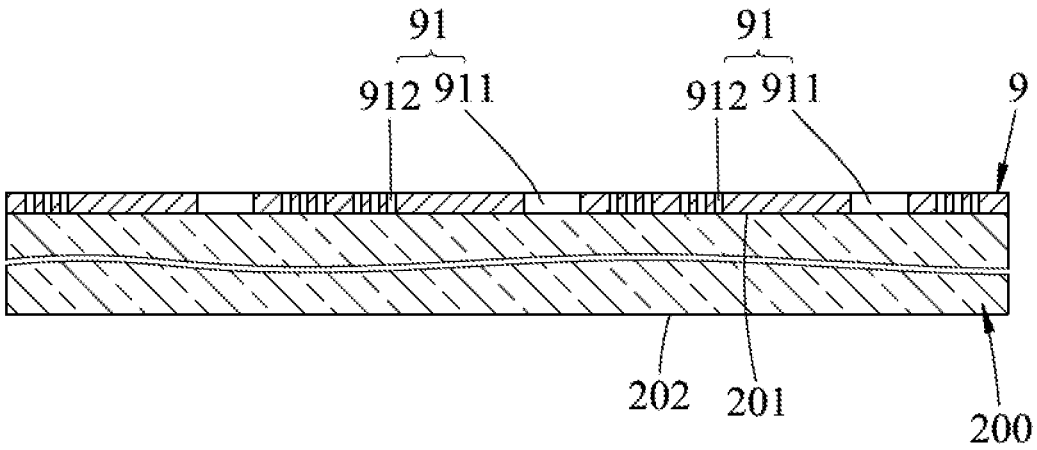

Specifically referring to FIGS. 3 and 4, in step A), an etchable substrate 200 is provided which has a top surface 201 and a bottom surface 202. The etchable substrate 200 is made from a silicon-based material, for example, a quartz plate having a thickness of about 250 μm.

In step B), a first masking layer 9 is applied on one of the top and bottom surfaces 201, 202 of the etchable substrate 200. In this illustrated embodiment, the first masking layer 9 is a patterned photoresist layer and is applied on the top surface 201 of the etchable substrate 200. The first masking layer 9 includes an array of first perforated patterns 91 which are displaced from each other by a predetermined spacing and each of which includes a first perforation 911 and a first coil-patterned slit 912 having a first inner slit end 9121 and a first outer slit end 9122 and disposed to surround the first perforation 911.

Figure 5:
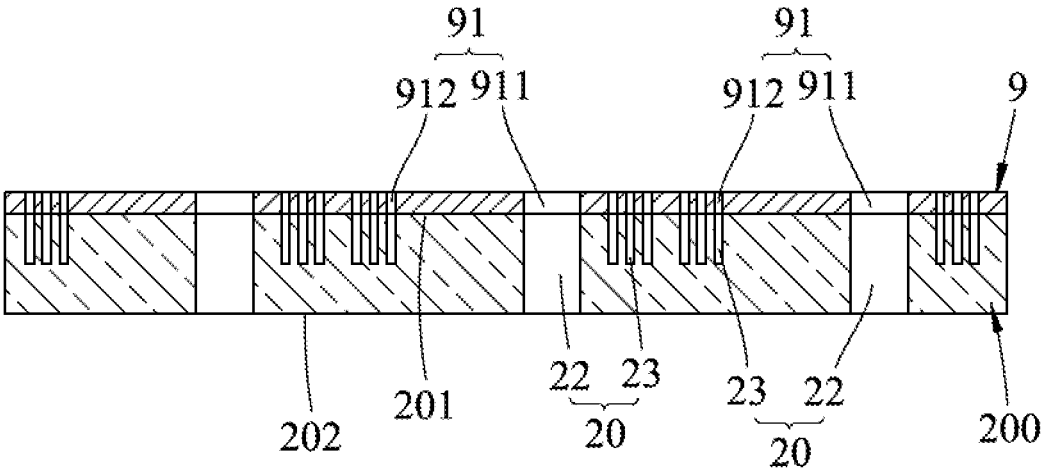

Referring FIG. 5, in step C), the etchable substrate 200 is etched through the first perforated patterns 91 of the first masking layer 9 to permit the etchable substrate 200 to be formed with an array of first recessed patterns 20 which are recessed from the top surface 201 of the etchable substrate 200. Each of the first recessed patterns 20 includes a first core recess portion 22 which corresponds to the first perforation 911, and a first coil-patterned recess portion 23 which corresponds to the first coil-patterned slit 912 and which has a depth smaller than that of the first core recess portion 22. The first coil-patterned recess portion 23 has a width which is smaller than a diameter of the first core recess portion 22. In this illustrated embodiment, the first core recess portion 22 is configured to be a via hole extending from the top surface 201 to the bottom surface 202 of the etchable substrate 200. Step C) is performed by a wet etching process using hydrofluoric acid (HF).

Figure 6:
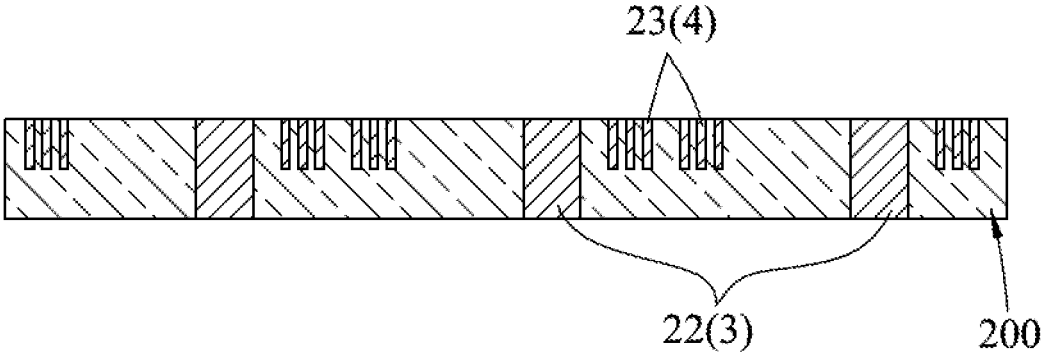

Referring to FIG. 6, in step D), a magnetic material and a conductive material are respectively filled into the first core recess portion 22 and the first coil-patterned recess portion 23 of each of the first recessed patterns 20 so as to form in the etchable substrate 200 a plurality of first magnetic cores 3 and a plurality of first conductive coils 4. Preferably, the first magnetic cores 3 are formed before the first conductive coils 4. Specifically, a ceramic green paste is formed by compounding magnetic ceramic powders, an organic solvent, and a binder, and is then filled into the first core recess portion 22 of each of the first recessed patterns 20 via extrusion, followed by evaporation of the organic solvent and solidification of the binder to form the first magnetic cores 3. Thereafter, a precursor layer or a seed layer is formed in the first coil-patterned recess portion 23 of each of the first recessed patterns 20, followed by deposition of the conductive material from the precursor layer or the seed layer via electroless plating or electroplating to form the first conductive coils 4. In this illustrated embodiment, the magnetic ceramic powders are made from ferrite ($Fe_3O_4$), and the conductive material is made from copper (Cu).

Figure 7:
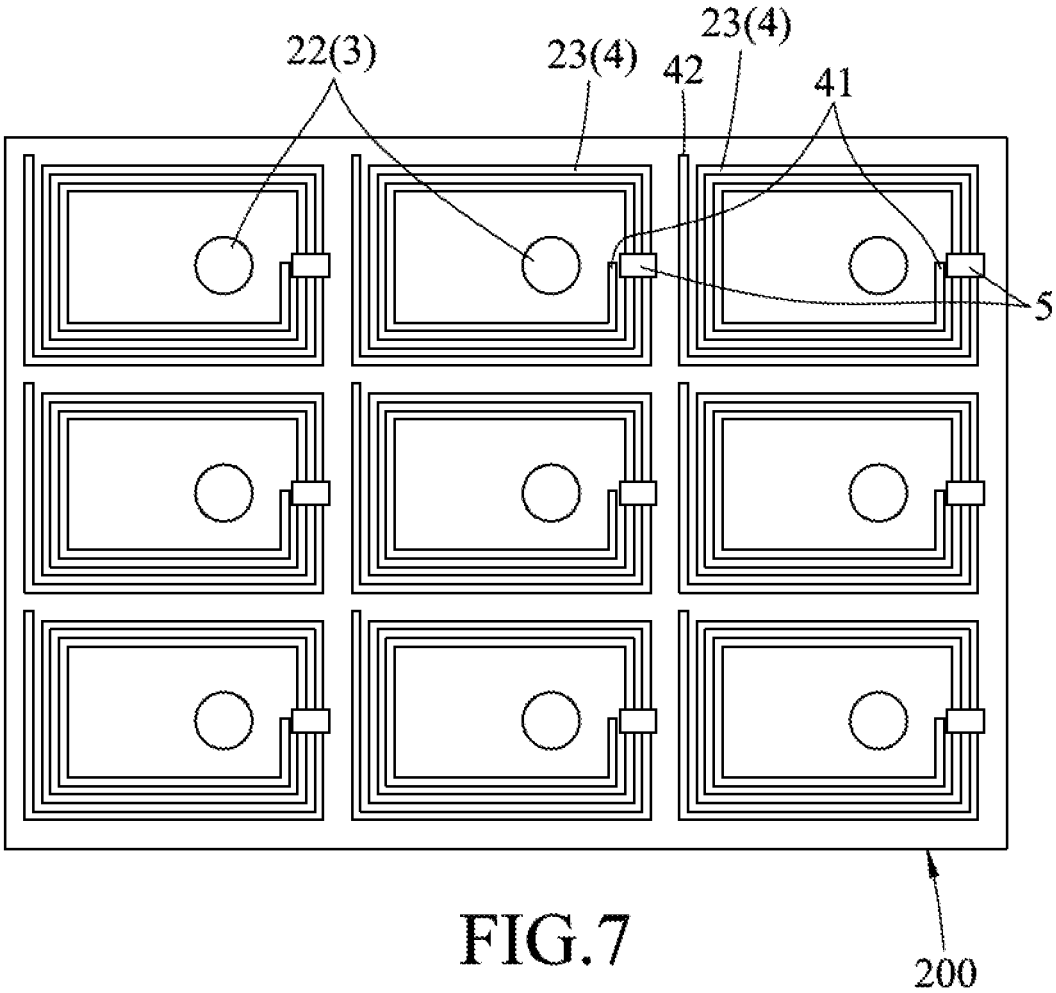

Specifically referred to FIGS. 3 and 7, each of the first conductive coils 4 has a first inner end 41 and a first outer end 42 respectively corresponding to the first inner slit end 9121 and the first outer slit end 9122 of the first coil-patterned slit 912. Since the first core recess portion 22 is configured to be a via hole extending from the top surface 201 to the bottom surface 202 of the etchable substrate 200 as described above, the first magnetic cores 3 formed in step D) is permitted to extend from the top surface 201 to the bottom surface 202 of the etchable substrate 200.

In step E), the first masking layer 9 is removed from the etchable substrate 200.

Figure 8:
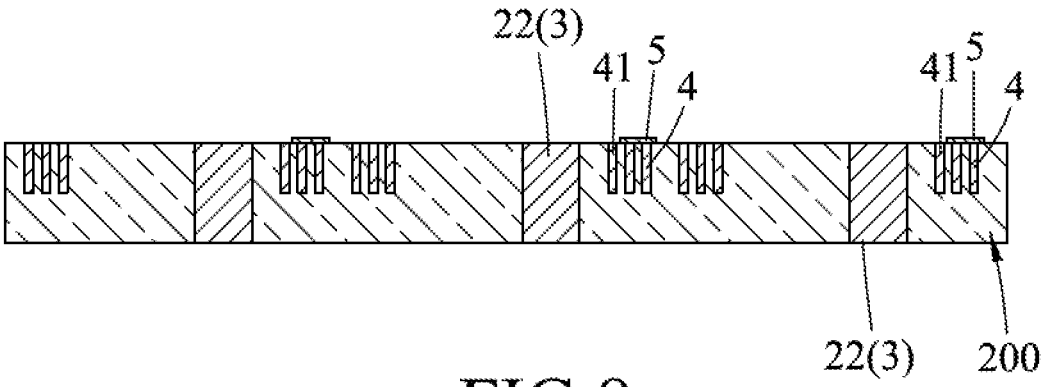

Referring to FIGS. 7 and 8, in step F), an insulation strip layer 5 is applied across each of the first conductive coils 4 in proximity to the first inner end 41 of each of the first conductive coils 4 for the first inner end 41 to be electrically led out.

Figure 9:
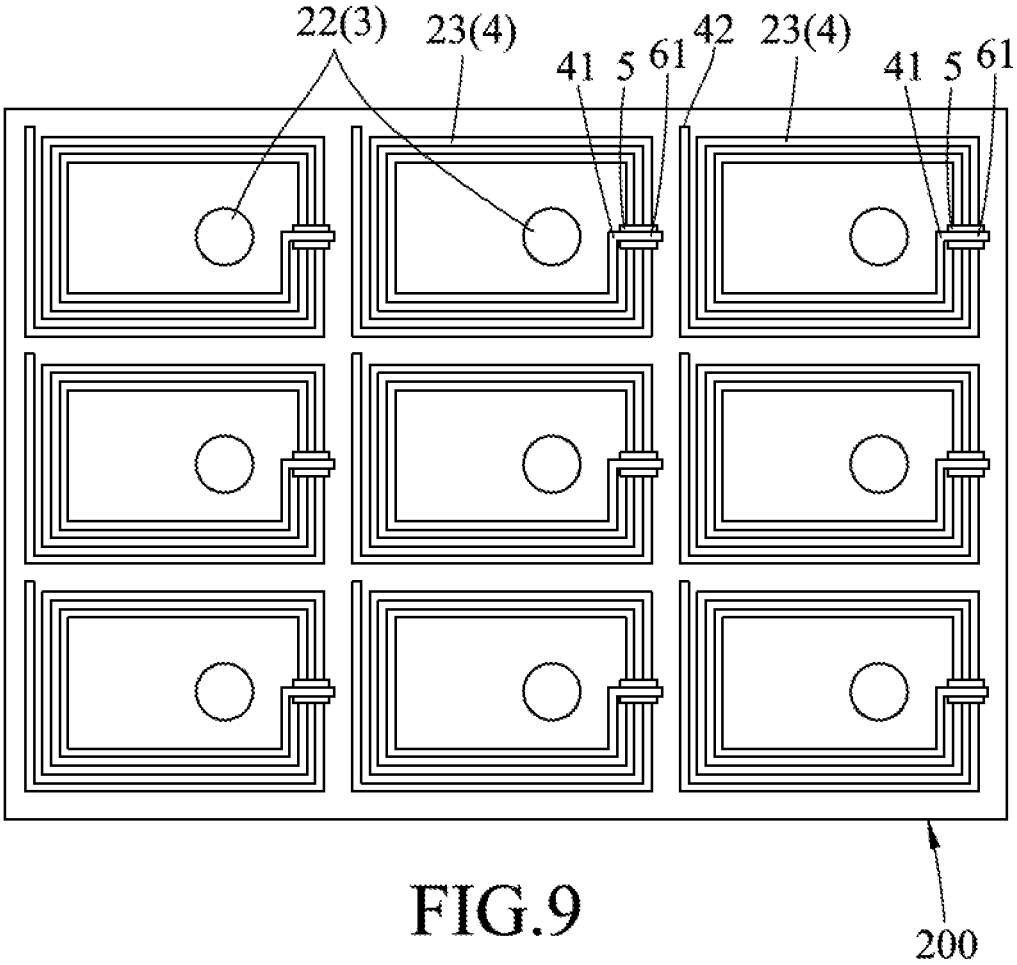
Figure 10:
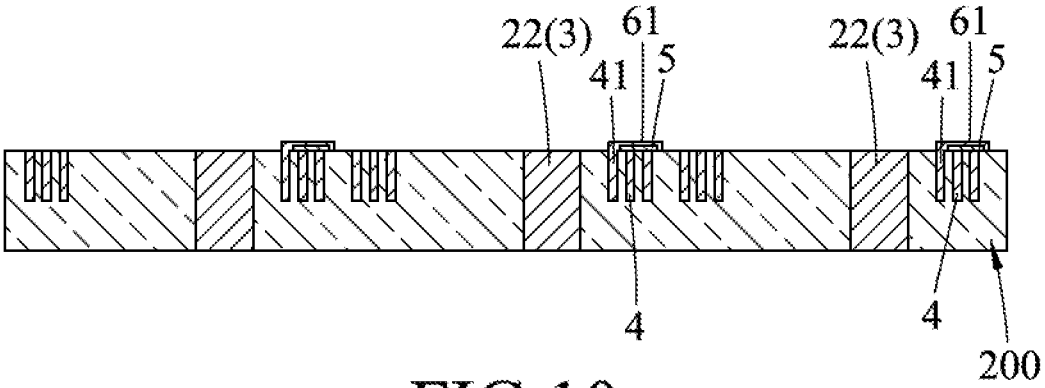

Referring to FIGS. 9 and 10, in step G), a conductive material is applied on the insulation strip layer 5 to form a conductive strip layer 61 to connect the first inner end 41 of a corresponding one of the first conductive coils 4 to serve as a conductive terminal.

Figure 11:
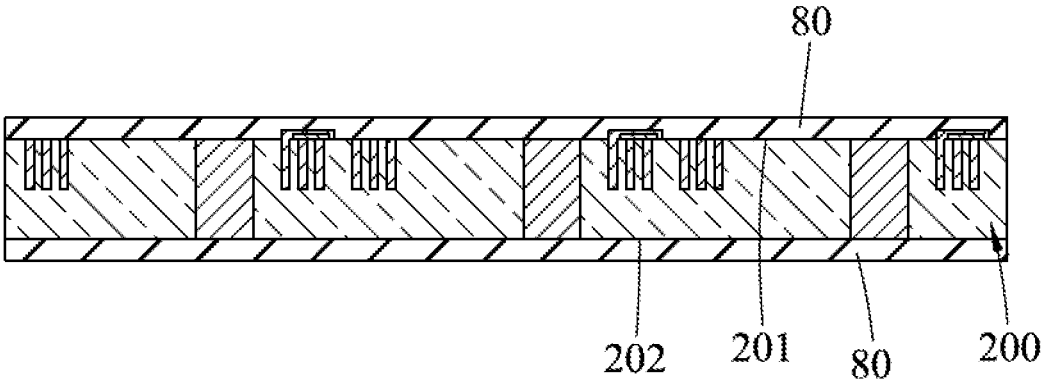

Referring to FIG. 11, in step H), a magnetic cover layer 80 is applied on each of the top and bottom surfaces 201, 202 of the etchable substrate 200 via lamination, coating, printing, or the like. In this illustrated embodiment, the magnetic cover layer 80 is a ferrite layer having a thickness of from about 5 μm to 100 μm.

Figure 12:
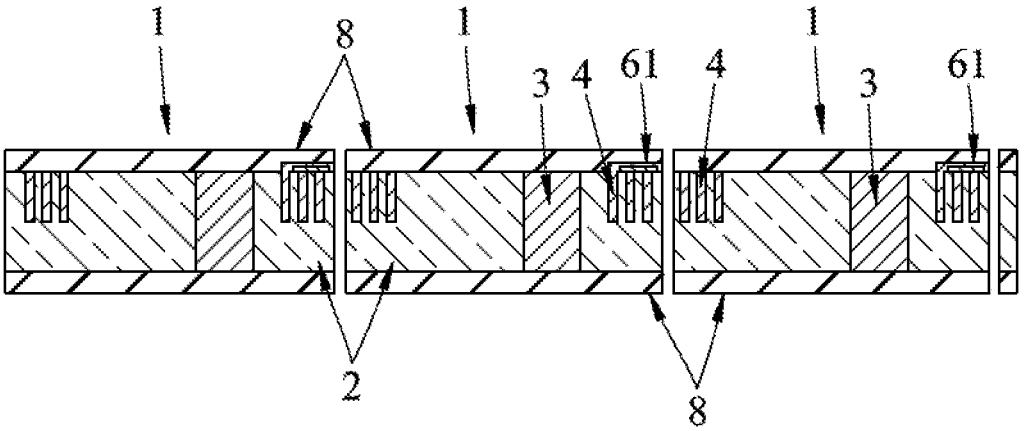

Referring to FIG. 12, in step I), the etchable substrate 200 is sliced along the predetermined spacing to obtain a plurality of choke bodies 1.

Figure 13:
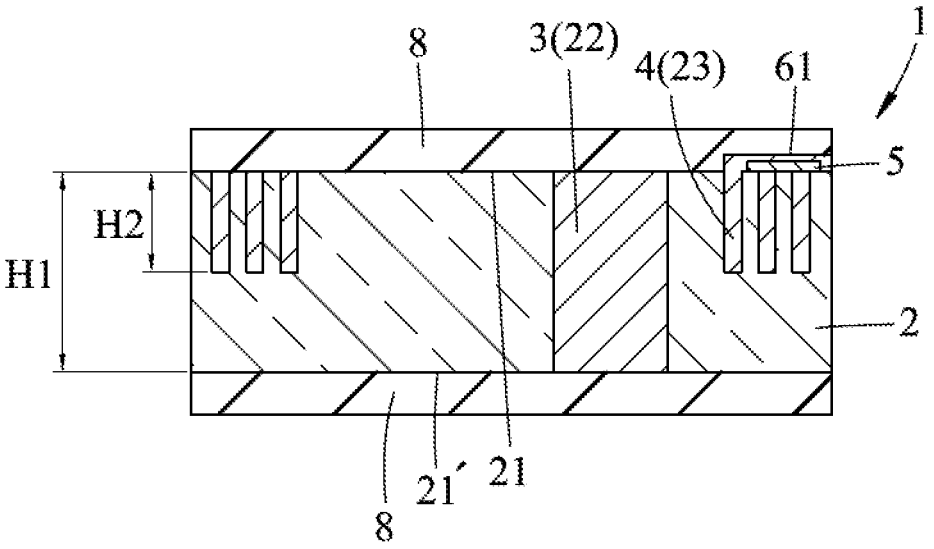
FIG. 13 is a schematically sectional view illustrating a low-profile choke made by the first embodiment.
Figure 14:
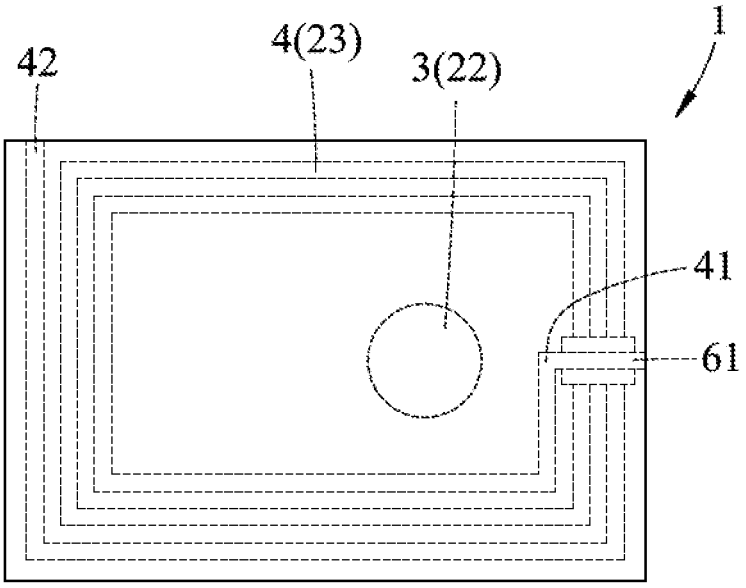
FIG. 14 is a schematic top view of the low-profile choke made by the first embodiment.

Referring to FIGS. 12, 13 and 14, a low-profile choke made by the first embodiment of the process according to the disclosure comprises a choke body 1, which includes a substrate region 2, the first magnetic core 3, the first conductive coil 4, the insulation strip layer 5, the conductive strip layer 61, and two magnetic covers 8.

The substrate region 2 has a top surface 21 and a bottom surface 21' and is formed with the first core recess portion 22 and the first coil-patterned recess portion 23. The first core recess portion 22 extends from the top surface 21 to the bottom surface 21' of the substrate region 2. The first coil-patterned recess portion 23 extends inwardly from one of the top and bottom surfaces 21, 21' of the substrate region 2 and has a depth smaller than that of the first core recess portion 22. In the low-profile choke illustrated in FIG. 13, the first coil-patterned recess portion 23 extends inwardly from the top surfaces 21 of the substrate region 2. The first magnetic core 3 is formed in the first core recess portion 22. The first conductive coil 4 is formed in the first coil-patterned recess portion 23. The insulation strip layer 5 is formed across the first conductive coil 4 in proximity to the first inner end 41 of the first conductive coil 4. The conductive strip layer 61 is formed on the insulation strip layer 5 to connect the first inner end 41 of the first conductive coil 4 to serve as a conductive terminal. In the low-profile choke illustrated in FIG. 13, the first outer end 42 of the first conductive coil 4 is served as another conductive terminal.

The two magnetic covers 8 are respectively formed on the top and bottom surfaces 21, 21' of the substrate region 2.

It should be noted that the first magnetic core 3 should have a sufficient volume so as to provide satisfactory permeability for the low-profile choke. Therefore, a height (H1) of the first magnetic core 3 should be larger than a height (H2) of the first conductive coil 4. Furthermore, when the first conductive coil 4 has a cross section area smaller than 100 $\mu m^2$, the low-profile choke may have an undesirably large direct current impedance. On the other hand, when the cross section area of the first conductive coil 4 is larger than $15\times10^4$ $\mu m^2$, the conductive material for the first conductive coil 4 is not cost effective. Therefore, the cross section area of the first conductive coil 4 is preferably in a range from 100 $\mu m^2$ to $15\times10^4$ $\mu m^2$. In the low-profile choke illustrated in FIG. 13, The height (H1) of the first magnetic core 3 is 250 μm, the height (H2) of the first conductive coil 4 is 100 μm, and the cross section of the first conductive coil 4 is 5000 $\mu m^2$.

Figure 15:
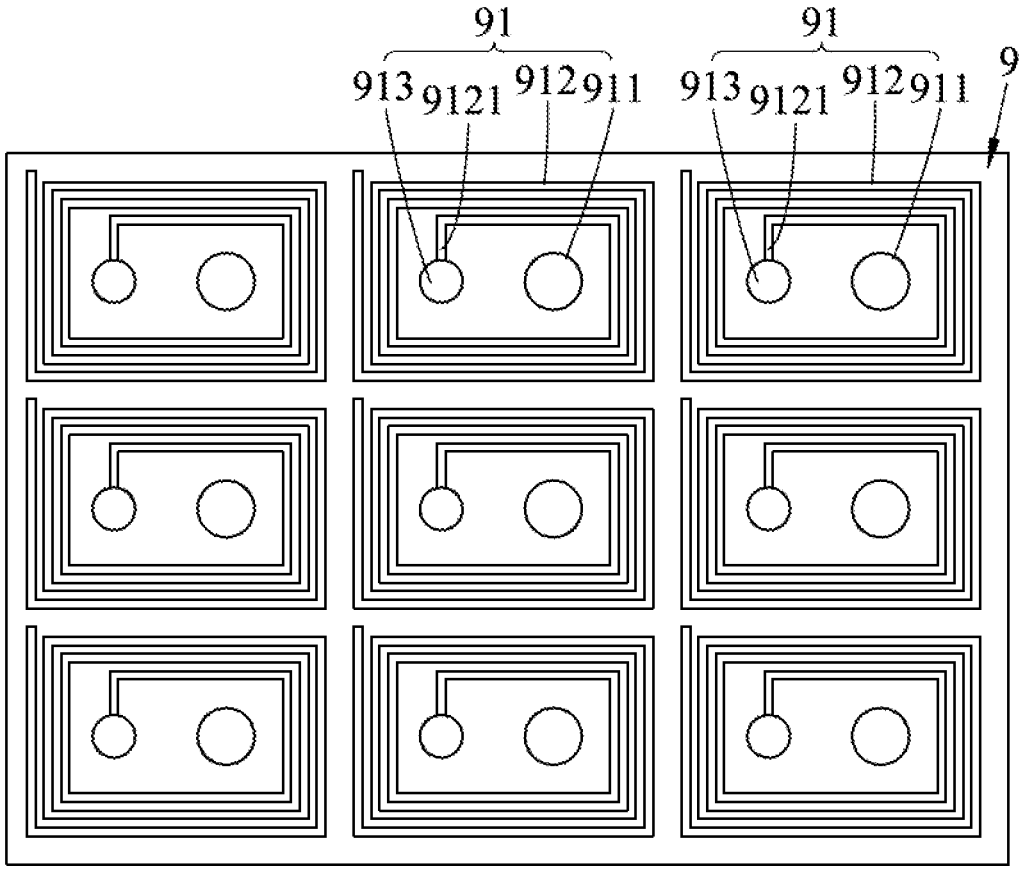
FIGS. 15 to 19 are schematic views showing some steps of a second embodiment of a process for making a low-profile choke according to the disclosure.
Figure 16:
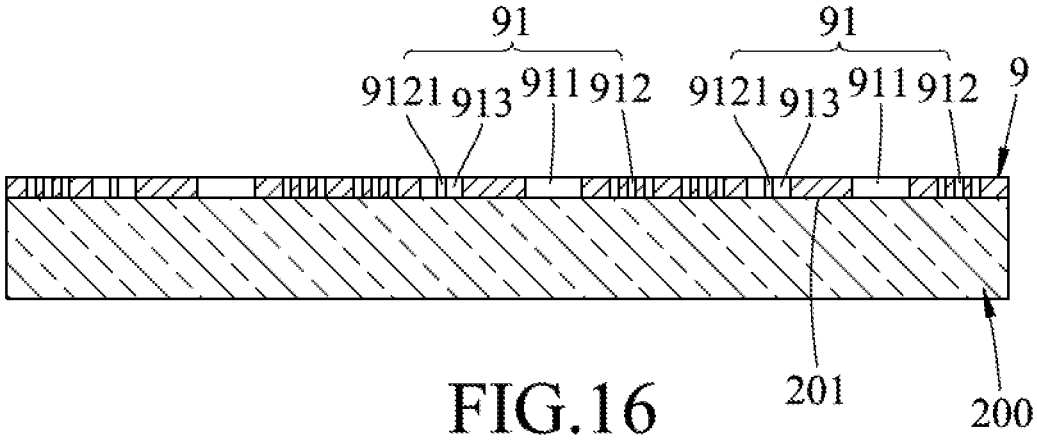

Referring to FIGS. 15-21, a second embodiment of a process for making a low-profile choke according to the disclosure is similar to the first embodiment except for the followings:

Referring to FIGS. 15 and 16, in step B), each of the first perforated patterns 91 of the first masking layer 9 further includes a second perforation 913 displaced from the first perforation 911 and communicated with the first inner slit end 9121 of the first coil-patterned slit 912.

Figure 17:
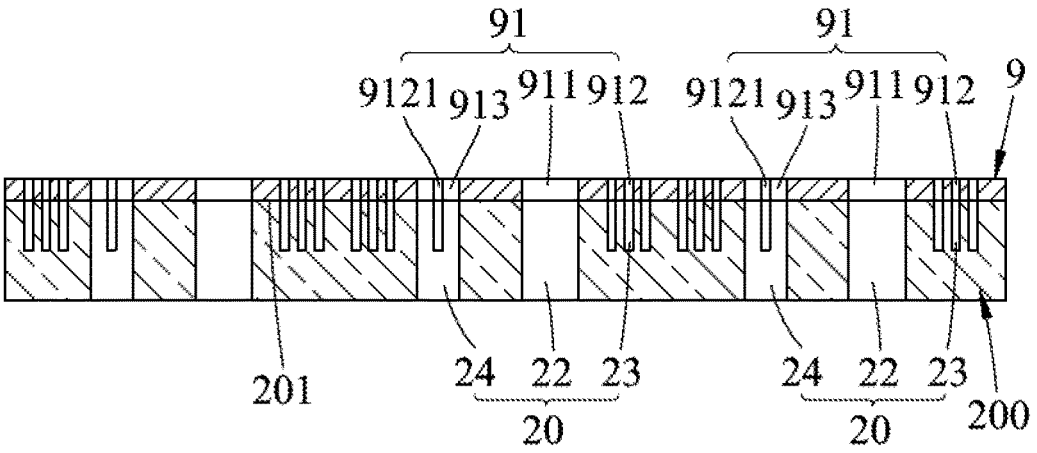

Referring to FIG. 17, in step C), each of the first recessed patterns 20 further includes a through recess 24 which is formed by etching the etchable substrate 200 through the second perforation 913.

Figure 18:
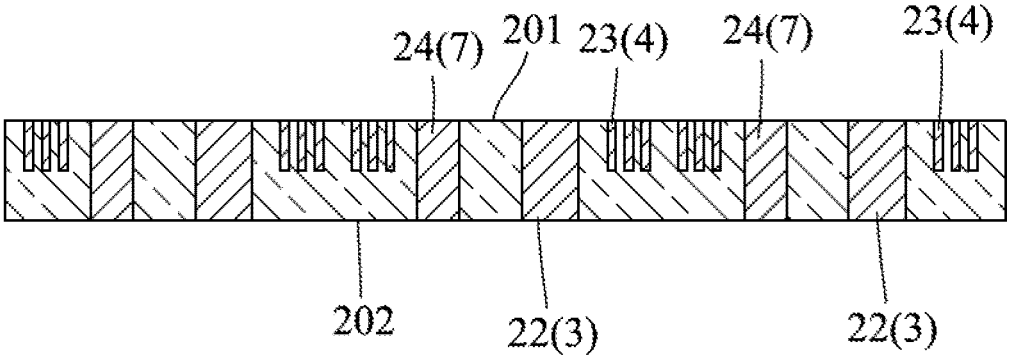

Referring to FIG. 18, in step D), the through recess 24 is filled with the conductive material to form a conductive post 7 which is flush with the top and bottom surfaces 201, 202 of the etchable substrate 200.

Figure 19:
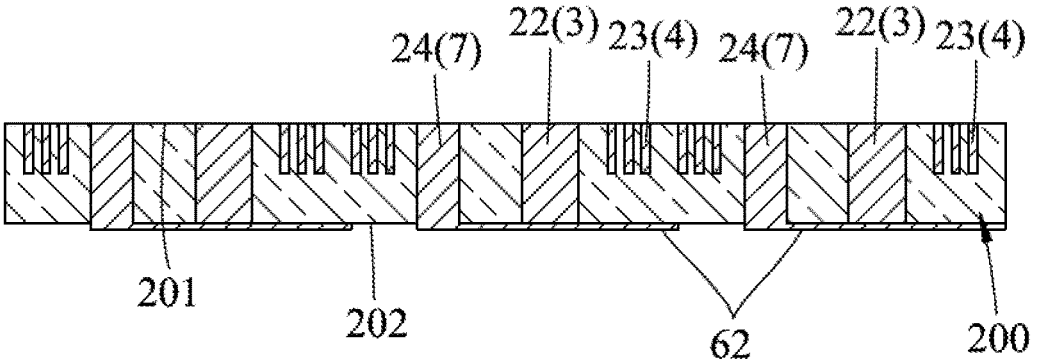

Referring to FIG. 19, steps F) and G) performed in the first embodiment are omitted. Instead, a conductive strip layer 62 is formed on the bottom surface 202 of the etchable substrate 200 to connect the conductive post 7 so as to serve as a conductive terminal.

Figure 20:
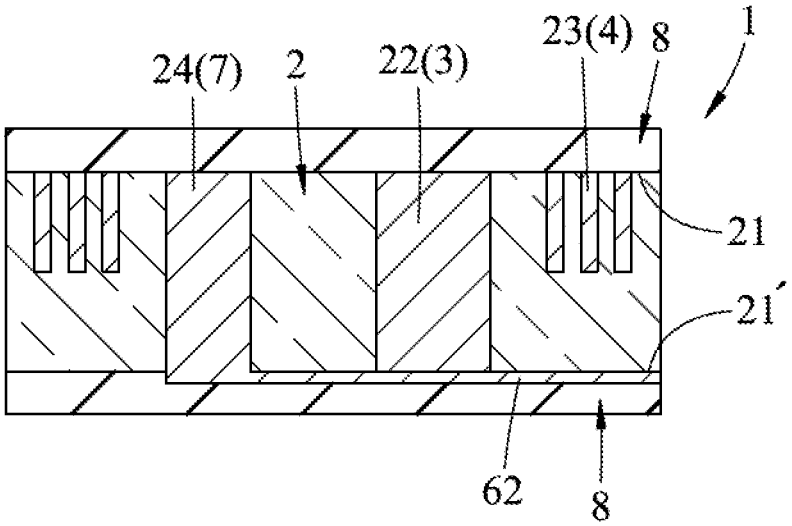
FIG. 20 is a schematically sectional view illustrating a low-profile choke made by the second embodiment.
Figure 21:
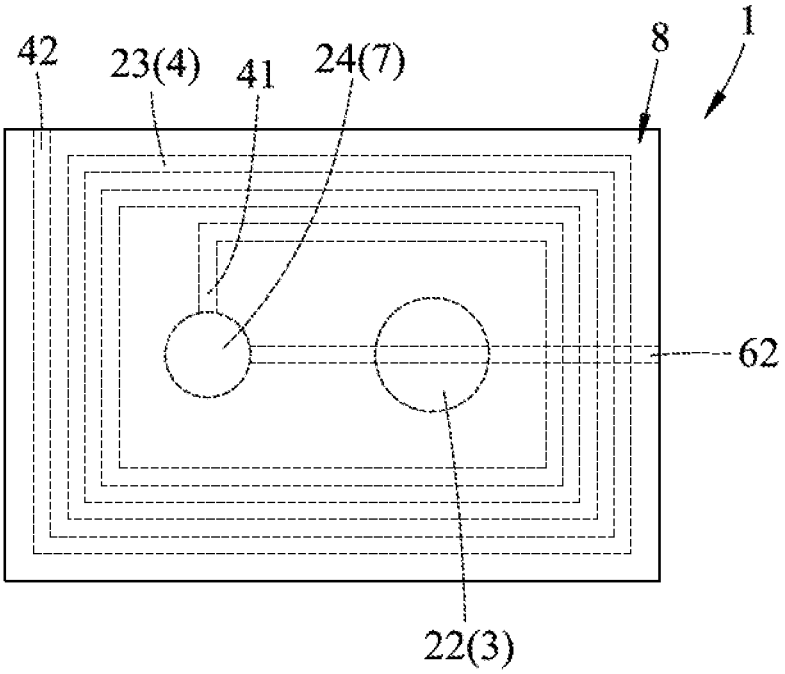
FIG. 21 is a schematic top view of the low-profile choke made by the second embodiment.

Referring to FIGS. 20 and 21, a low-profile choke made by the second embodiment of the process according to the disclosure is similar to the low-profile choke made by the first embodiment of the process according to the disclosure except for the followings:

In the low-profile choke made by the second embodiment, the substrate region 2 is further formed with the through recess 24. The conductive post 7 is included and formed in the through recess 24, and is connected to the first inner end 41 of the first conductive coil 4. The conductive strip layer 62 is formed on the bottom surface 21' of the substrate portion 21' to connect the conductive post 7 so as to serve as a conductive terminal.

Referring to FIGS. 22-25, a third embodiment of a process for making a low-profile choke according to the disclosure is similar to the second embodiment except that the third embodiment further comprises following steps B'), C'), and D').

Figure 22:
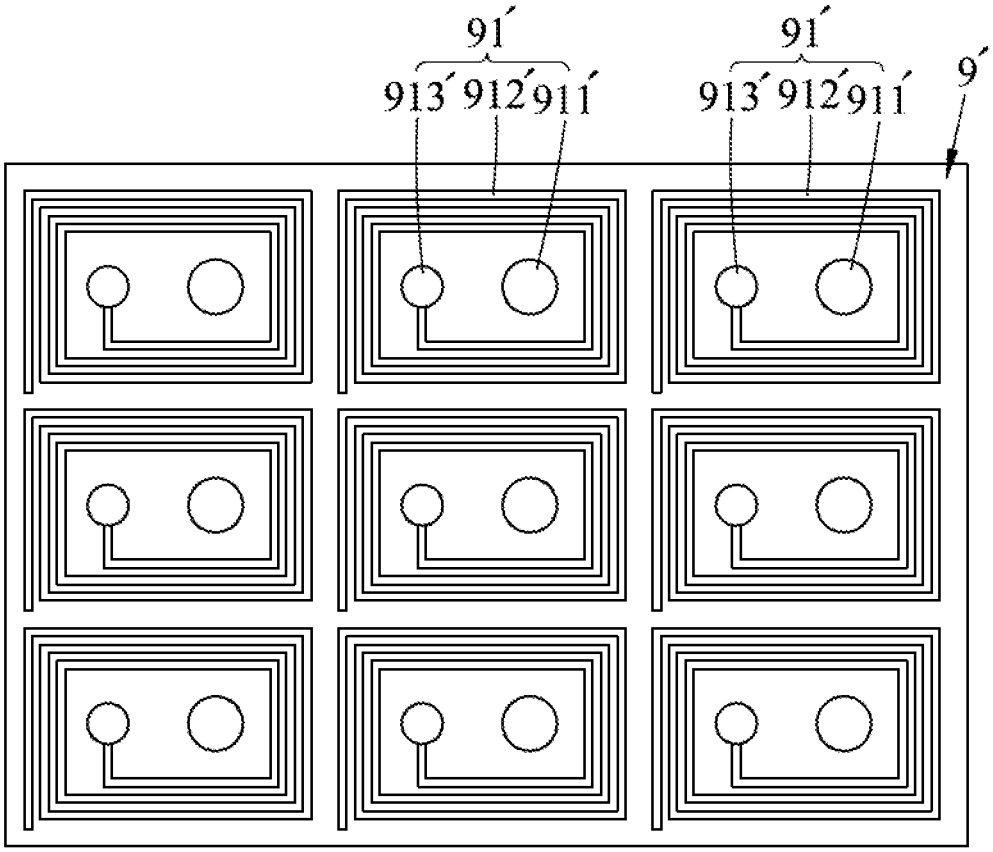
FIGS. 22 to 25 are schematic views showing some steps of a third embodiment of a process for making a low-profile choke according to the disclosure.
Figure 23:
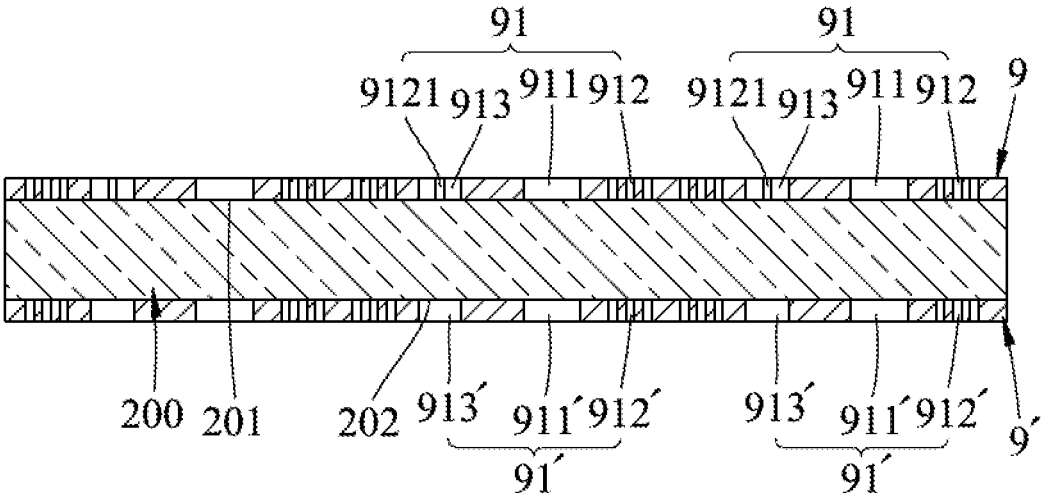
Figure 24:
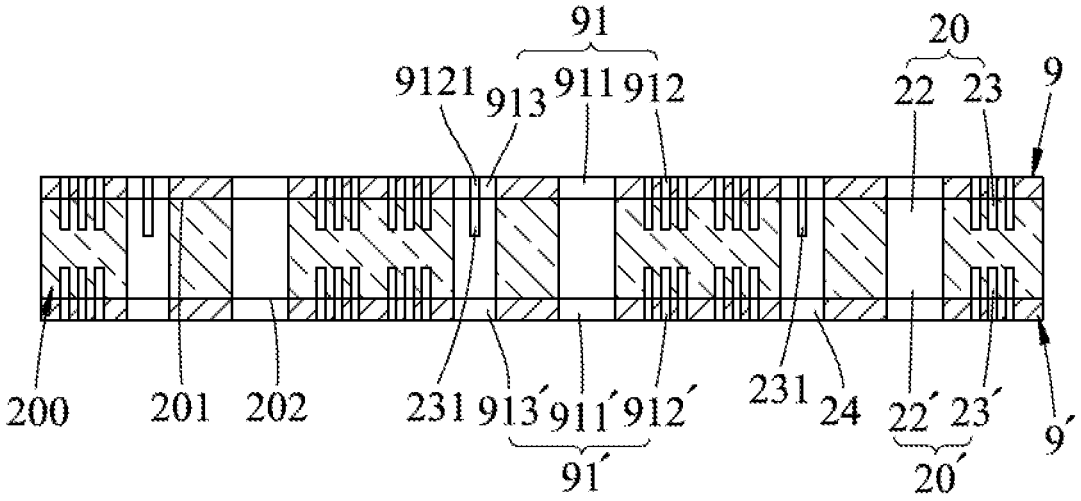

Referring to FIGS. 22, 23, and 24, in step B'), a second masking layer 9' is applied on the other of the top and bottom surfaces 201, 202 of the etchable substrate 200. As shown in FIG. 23, in the illustrated third embodiment, the second masking layer 9' is applied on the bottom surface 202 of the etchable substrate 200. The second masking layer 9' includes an array of second perforated patterns 91' which are displaced from each other by a predetermined spacing and each of which includes a third perforation 911', a fourth perforation 913' displaced from the third perforation 911', and a second coil-patterned slit 912'. The third perforation 911' is brought into register with the first perforation 911. The second coil-patterned slit 912' has a second outer slit end and a second inner slit end that is communicated with the through recess 24, and is disposed to surround the third perforation (911').

In step C'), the etchable substrate 200 is etched through the second perforated patterns 91' of the second masking layer 9' to permit the etchable substrate 200 to be formed with an array of second recessed patterns 20' which are recessed from the other of the top and bottom surfaces 201, 202 of the etchable substrate 200. As shown in FIG. 24, in the illustrated third embodiment, the second recessed patterns 20' are recessed from the bottom surfaces 202 of the etchable substrate 200. Each of second recessed patterns 20' includes a second core recess portion 22' which corresponds to the third perforation 911', and a second coil-patterned recess portion 23' which corresponds to the second coil-patterned slit 912' and which has a depth smaller than that of the second core recess portion 22'. In the third embodiment, the second core recess portion 22' is permitted to form, in corporation with the first core recess portion 22, a core recess unit extending from the top surface 201 to the bottom surface 202 of the etchable substrate 200.

Figure 25:
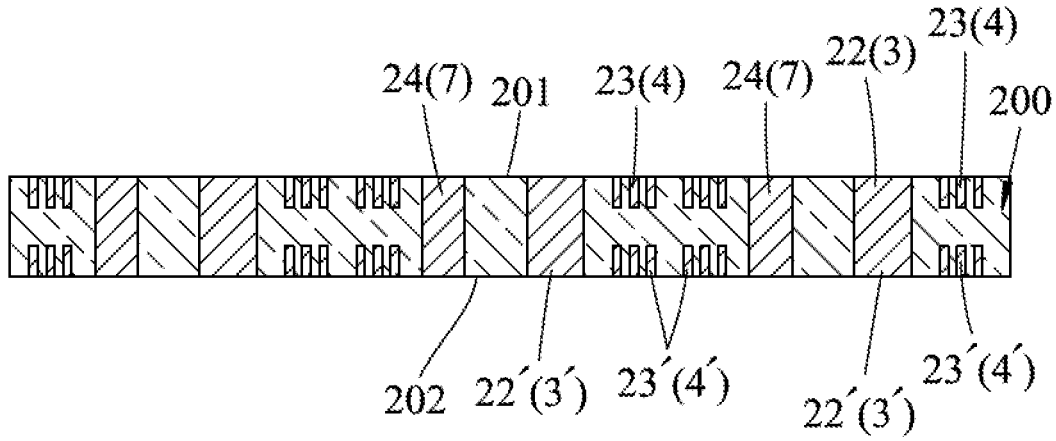

Referring to FIG. 25, in step D'), the magnetic material and the conductive material are filled respectively into the second core recess portion 22' and the second coil-patterned recess portion 23' of each of the second recessed patterns 20' so as to form in the etchable substrate 200 a plurality of second magnetic cores 3' and a plurality of second conductive coils 4'. Each of the second conductive coils 4' has a second inner end and a second outer end respectively corresponding to the second inner slit end and the second outer slit end of the second coil-patterned slit 912' such that the second inner end of each of the second conductive coils 4' is connected to the conductive post 7. In the third embodiment, each of the second magnetic cores 3' is permitted to be combined with a corresponding one of the first magnetic cores 3 to form a magnetic core unit extending from the top surface 201 to the bottom surface 202 of the etchable substrate 200.

Figure 26:
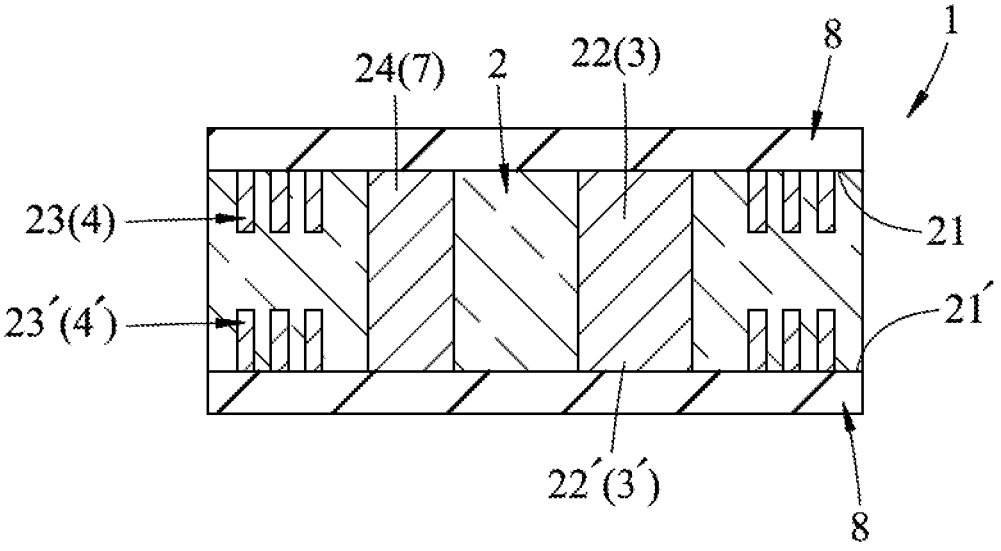
FIG. 26 is a schematically sectional view illustrating a low-profile choke made by the third embodiment.
Figure 27:
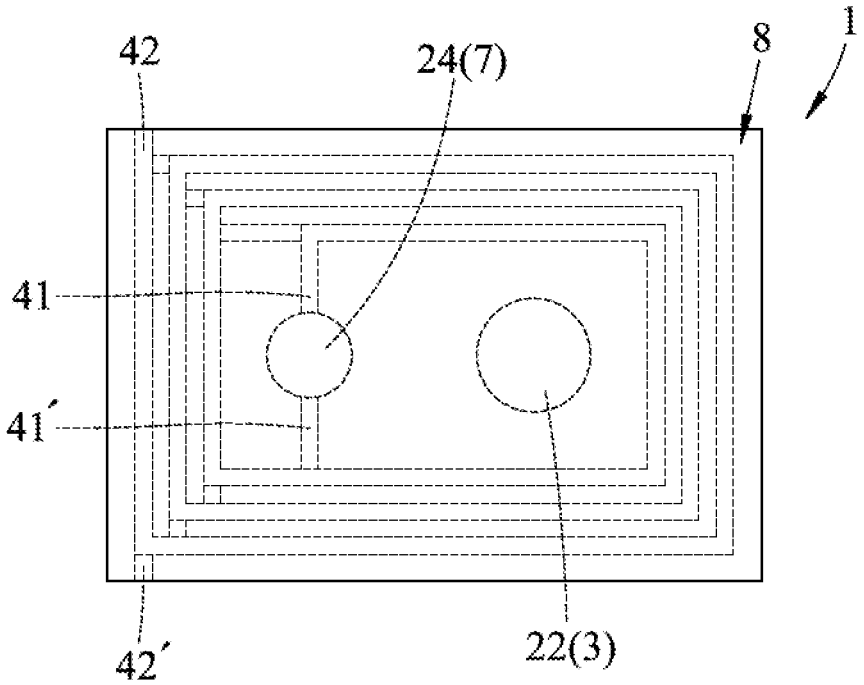
FIG. 27 is a schematic top view of the low-profile choke made by the third embodiment.

Referring to FIGS. 26 and 27, a low-profile choke made by the third embodiment of the process according to the disclosure is similar to the low-profile choke made by the second embodiment of the process according to the disclosure except for the followings:

In the low-profile choke made by the third embodiment, the magnetic core unit, which is formed by combining the second magnetic cores 3' with the first magnetic core 3, is disposed within the core recess unit, which is formed by the second core recess portion 22' in corporation with the first core recess portion 22. In addition, the second conductive coil 4' has a second inner end 41' and a second outer end 42'. The second inner end 41' of the second conductive coils 4' is connected to the conductive post 7. The first outer end 42 of the first conductive coil 4 and the second outer end 42' of the second conductive coil 4' serve as two conductive terminals.

In view of the aforesaid, the process for making a low-profile choke according to the disclosure can make a plurality of the low-profile chokes simultaneously, and each of the low-profile chokes thus made has a miniaturized thickness of about from 260 μm to 650 μm so as to meet the requirement for various miniaturized portable electronic devices. In addition, in each of the low-profile chokes thus made, the first conductive coil 4 is formed within the first coil-patterned recess portion 23 so as to provide sufficient cross section area and volume therefor. Therefore, the direct current impedance of each of the low-profile chokes thus made is relatively low such that the overheating problem which may be encountered in common chokes can be alleviated or even eliminated.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A process for making a low-profile choke, comprising steps of:

a) providing an etchable substrate having a top surface and a bottom surface;

b) applying on one of the top and bottom surfaces of the etchable substrate a first masking layer including an array of first perforated patterns which are displaced from each other by a predetermined spacing and each of which includes a first perforation and a first coil-patterned slit having a first inner slit end and a first outer slit end and disposed to surround the first perforation;

c) etching the etchable substrate through the first perforated patterns of the first masking layer to permit the etchable substrate to be formed with an array of first recessed patterns which are recessed from said one of the top and bottom surfaces of the etchable substrate, each of the first recessed patterns including a first core recess portion which corresponds to the first perforation and a first coil-patterned recess portion which corresponds to the first coil-patterned slit and which has a depth smaller than a depth of the first core recess portion;

d) filling a magnetic material and a conductive material respectively into the first core recess portion and the first coil-patterned recess portion of each of the first recessed patterns so as to form in the etchable substrate a plurality of first magnetic cores and a plurality of first conductive coils, each with a first inner end and a first outer end respectively corresponding to the first inner slit end and the first outer slit end of the first coil-patterned slit; and e) slicing the etchable substrate along the predetermined spacing to obtain a plurality of choke bodies.

2. The process according to claim 1, further comprising a step of removing the first masking layer after step c).

3. The process according to claim 2, further comprising a step of applying a magnetic cover layer on each of the top and bottom surfaces of the etchable substrate before step e).

4. The process according to claim 1, wherein the first core recess portion is configured to be a via hole extending from the top surface to the bottom surface of the etchable substrate so as to permit the first magnetic cores formed in step d) to extend from the top surface to the bottom surface of the etchable substrate.

5. The process according to claim 1, further comprising a step of, after step d), of applying an insulation strip layer across each of the first conductive coils in proximity to the first inner end of each of the first conductive coils for the first inner end to be electrically led out.

6. The process according to claim 5, further comprising a step of applying a conductive material on the insulation strip layer to form a conductive strip layer to connect the first inner end of a corresponding one of the first conductive coils to serve as a conductive terminal.

7. The process according to claim 1, wherein in step b), each of the first perforated patterns of the first masking layer further includes a second perforation displaced from the first perforation and communicated with the first inner slit end of the first coil-patterned slit.

8. The process according to claim 7, wherein in step c), each of the first recessed patterns further includes a through recess which is formed by etching the etchable substrate through the second perforation.

9. The process according to claim 8, wherein in step d), the through recess is filled with the conductive material to form a conductive post which is flush with the other of the top and bottom surfaces of the etchable substrate.

10. The process according to claim 9, further comprising a step of forming a conductive strip layer on the other of the top and bottom surfaces of the etchable substrate to connect the conductive post so as to serve as a conductive terminal.

11. The process according to claim 9, further comprising a step of:

b') applying on the other of the top and bottom surfaces of the etchable substrate a second masking layer including an array of second perforated patterns which are displaced from each other by a predetermined spacing and each of which includes a third perforation, a fourth perforation displaced from the third perforation, and a second coil-patterned slit which has a second outer slit end and a second inner slit end that is communicated with the through recess, and which is disposed to surround the third perforation.

12. The process according to claim 11, further comprising a step of:

c') etching the etchable substrate through the second perforated patterns of the second masking layer to permit the etchable substrate to be formed with an array of second recessed patterns which are recessed from the other of the top and bottom surfaces of the etchable substrate, each of second recessed patterns including a second core recess portion which corresponds to the third perforation and a second coil-patterned recess portion which corresponds to the second coil-patterned slit and which has a depth smaller than a depth of the second core recess portion.

13. The process according to claim 12, further comprising a step of:

d') filling the magnetic material and the conductive material respectively into the second core recess portion and the second coil-patterned recess portion of each of the second recessed patterns so as to form in the etchable substrate a plurality of second magnetic cores and a plurality of second conductive coils, each with a second inner end and a second outer end respectively corresponding to the second inner slit end and the second outer slit end of the second coil-patterned slit such that the second inner end of each of the second conductive coils is connected to the conductive post.

14. The process according to claim 13, wherein in step b'), the third perforation is brought into register with the first perforation such that in step c'), the second core recess portion is permitted to form, in corporation with the first core recess portion, a core recess unit, thereby permitting each of the second magnetic cores to be combined with a corresponding one of the first magnetic cores to form a magnetic core unit.

* * * * *